US007314005B2

(12) United States Patent
Deye

(10) Patent No.: US 7,314,005 B2
(45) Date of Patent: Jan. 1, 2008

(54) FIREWORKS IGNITION SYSTEM FOR 1.4 FIREWORKS

(75) Inventor: James G. Deye, Cincinnati, OH (US)

(73) Assignee: Pyro Master, L.L.C., Cincinnati, OH (US)

( * ) Notice: Subject to any disclaimer, the term of this patent is extended or adjusted under 35 U.S.C. 154(b) by 30 days.

(21) Appl. No.: 11/214,305

(22) Filed: Aug. 29, 2005

(65) Prior Publication Data

US 2006/0164787 A1 Jul. 27, 2006

Related U.S. Application Data

(60) Provisional application No. 60/606,346, filed on Sep. 1, 2004.

(51) Int. Cl.
*F42B 4/24* (2006.01)
*F42B 4/00* (2006.01)

(52) U.S. Cl. ..... 102/356; 102/358; 102/360

(58) Field of Classification Search ..... 102/343–345, 102/349, 352, 355, 356, 360, 361
See application file for complete search history.

(56) References Cited

U.S. PATENT DOCUMENTS 1,667,180 A * 4/1928 Willson ..... 102/355
2,095,163 A * 10/1937 Hatsutaro ..... 102/361
2,099,783 A * 11/1937 Whiteside ..... 102/361
2,142,227 A * 1/1939 Whiteside ..... 102/361
3,227,084 A * 1/1966 Stokes et al. ..... 102/361
4,325,304 A * 4/1982 Ormiston ..... 102/200
5,567,907 A * 10/1996 Westfall ..... 102/344
5,739,459 A * 4/1998 La Mura et al. ..... 102/217
6,393,990 B1 * 5/2002 Fagan ..... 102/342
6,431,070 B1 * 8/2002 La Mura ..... 102/202.11
6,779,459 B2 * 8/2004 Werner ..... 102/349
6,851,371 B1 * 2/2005 Wah ..... 102/343

* cited by examiner

*Primary Examiner*—Bret Hayes
(74) *Attorney, Agent, or Firm*—Sand & Sebolt

(57) ABSTRACT

An ignition system for 1.4 g or consumer fireworks includes a base to which the fireworks are secured to prevent tipping thereof during shooting. The base is secured to the ground or other surface for stability. Preferably, the base is part of a container which encloses the fireworks in a pre-mounted fashion to protect the fireworks from the elements. Electrical matches or E-matches are used to ignite the fireworks and are controlled by an electrical control at a safe distance from the fireworks during the firing thereof.

20 Claims, 8 Drawing Sheets

FIREWORKS IGNITION SYSTEM FOR 1.4 FIREWORKS

CROSS REFERENCE TO RELATED APPLICATIONS

This application claims priority from U.S. Provisional Application Ser. No. 60/606,346 filed Sep. 1, 2004; the disclosure of which is incorporated herein by reference.

BACKGROUND OF THE INVENTION

1. Technical Field

The invention relates generally to an ignition system for 1.4 g or consumer fireworks. More particularly, the invention relates to such a system wherein ignition of fireworks is initiated electrically from a safe distance. Specifically, the invention relates to such a system wherein the fireworks are mounted to prevent tipping during the shooting thereof.

2. Background Information

In the pyrotechnic industry, fireworks are divided into various classifications. One of these classifications is 1.3 g explosives, also known as class B or professional fireworks. These professional fireworks are shot by hand torch, analog electrical systems and digital electrical firing systems.

Another classification is known as the 1.4 g fireworks, also known as consumer fireworks, which are typically purchased at roadside stores and stands. Consumer or 1.4 g fireworks are ignited with a hand lighting technique. Many consumers desire to purchase such fireworks and put on a show in their backyard. The 1.4 g or consumer explosives are to be placed on a solid surface and typically have what is known as a green fuse with a three-second burn delay so that the person lighting the firework can move to a safe distance from the firework before it shoots. Despite printed safety instructions and precautions, many injuries result from the use of such consumer fireworks. Most commonly, such injuries are caused by a device falling over after being ignited due to having an unstable base whereby the firework is shot toward the person lighting the device or toward a spectator to the show. In addition, injuries are caused by faulty fuses which burn too quickly or where the person lighting the fuse is for any number of reasons simply unable to move away from the firework quickly enough. Moreover, other fuses may be faulty in that they burn too slowly and appear to have burned out already, so that an unsuspecting consumer re-approaches the firework which explodes at that time. The present invention addresses these and other concerns.

BRIEF SUMMARY OF THE INVENTION

The present invention provides a fireworks ignition system comprising a plurality of electrically ignitable 1.4 g fireworks; and a base to which the fireworks are secured to prevent tipping of the fireworks during launch thereof; wherein the base is adapted to sit on a stable surface.

In one preferred embodiment, the base is part of a container which is movable between a closed position in which the fireworks are disposed within the container and an open position in which the fireworks are electrically ignitable and launchable from the container.

The present invention also provides a method comprising the steps of securing to a stable surface a base on which a plurality of 1.4 g fireworks are mounted in a manner to prevent the tipping of the fireworks during shooting thereof; and igniting electrically at least one of the fireworks.

DETAILED DESCRIPTION OF THE INVENTION

Figure 1:
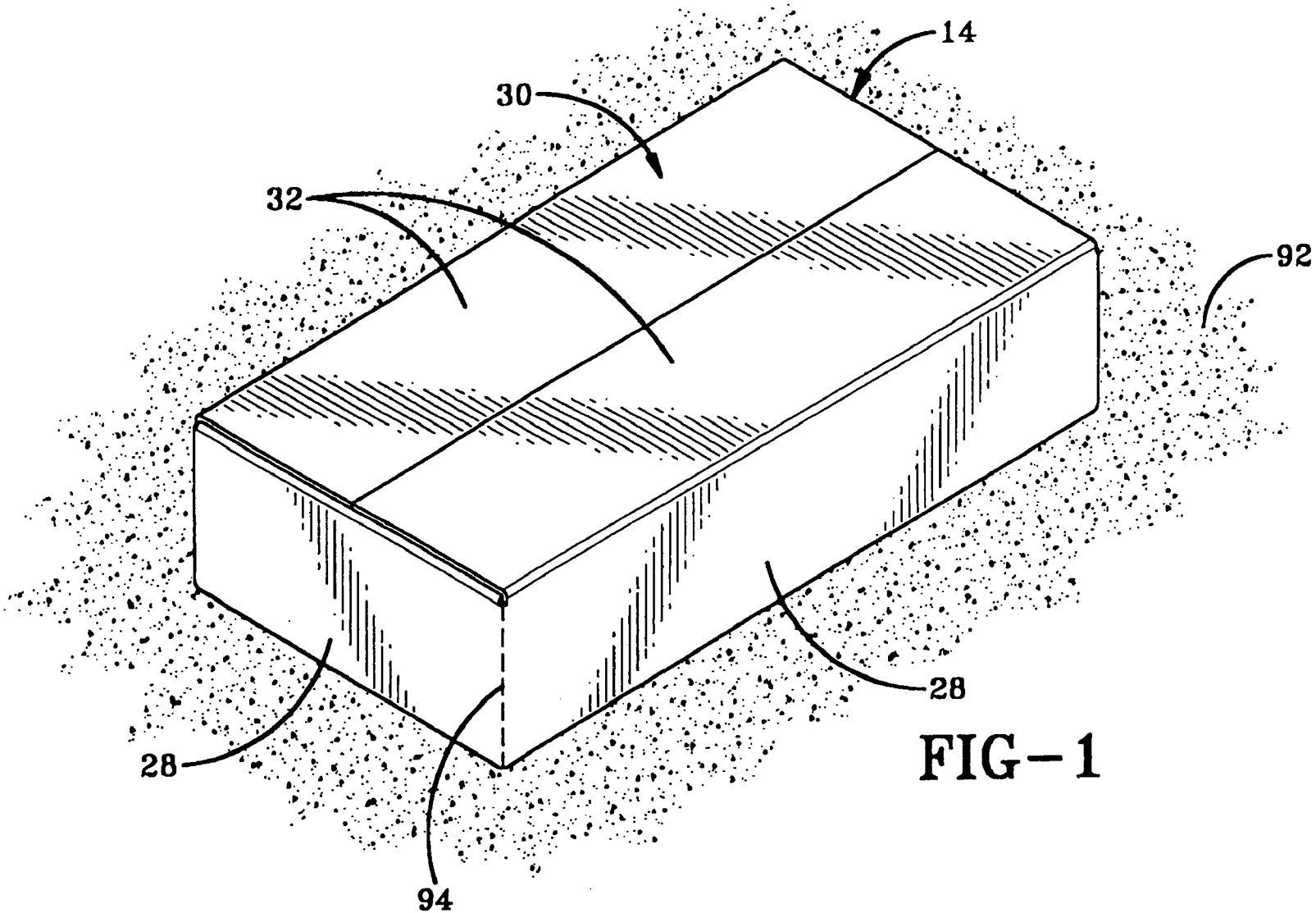
FIG. 1 is a perspective view of a box for consumer fireworks used with the ignition system of the present invention, with the box being in a closed position and positioned on a surface.

The ignition system of the present invention is indicated generally at 10 in FIG. 1, and includes a box or container 14 housing a plurality of fireworks as will be described in more detail herein below. System 10 includes a plurality of 1.4 g fireworks 12 (FIG. 4) which, in accordance with a feature of the invention, are mounted on a container or box 14 in a manner to prevent fireworks 12 from tipping over during the shooting thereof. Each firework 12 is in electrical communication with an electrical control 16 via a plurality of electrical conductors 18. Ignition system 10 is configured to safely ignite and shoot 1.4 g fireworks 12 using electrically initiated ignition.

Figure 4:
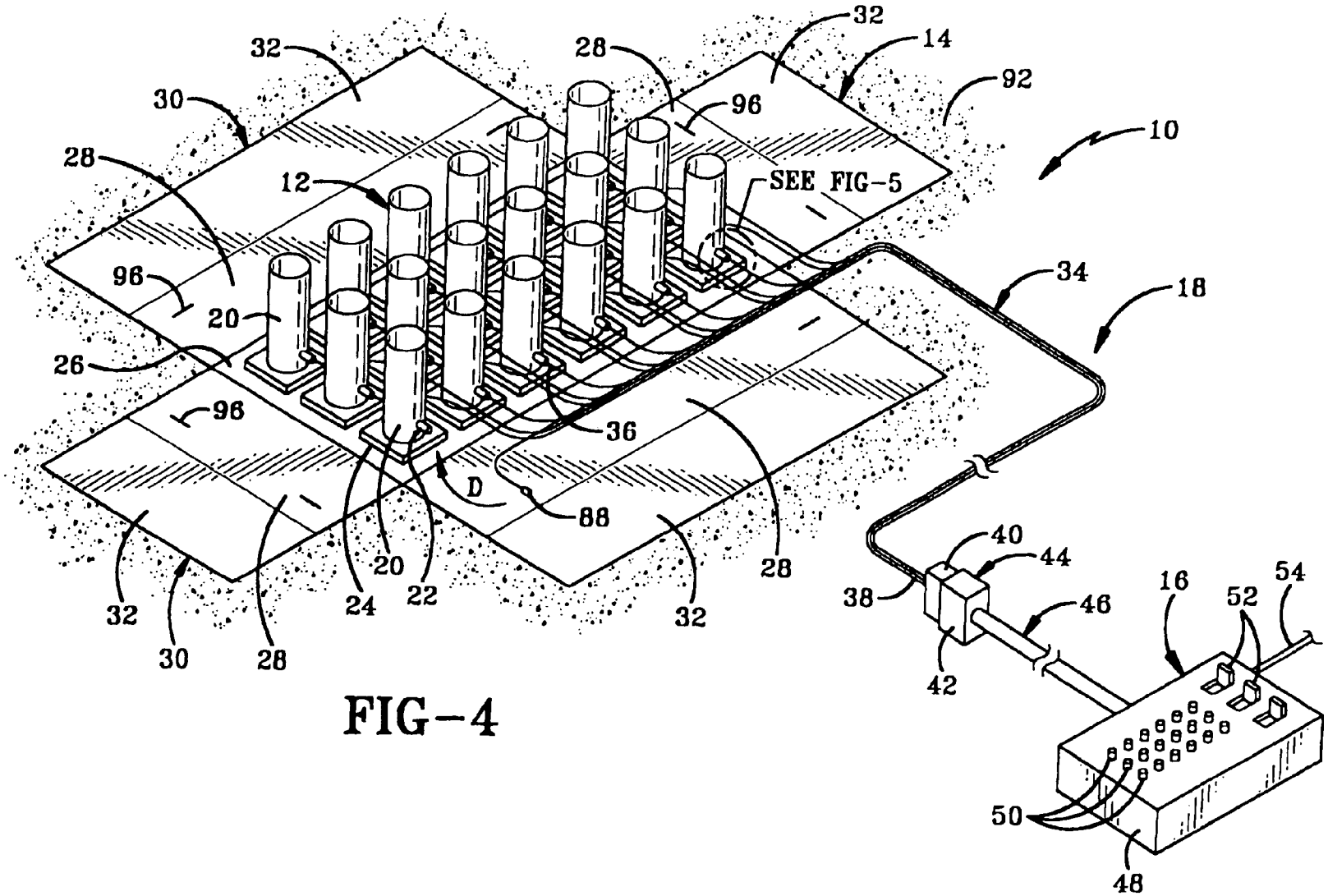
FIG. 4 is a perspective view of the ignition system of the present invention with the box and fireworks shown as in FIG. 3 and with each firework having a fuse electrically connected to an electrical control device for electrically igniting the fireworks.

With continued reference to FIG. 4, each 1.4 g firework includes a body 20 with a fuse element 22 extending outwardly therefrom. Fuse element 22 is described further below. Body 20 of firework 12 is mounted on a mounting member or base 24 which is mounted on a base or base wall 26 of box 14. Base 24 of each firework 12 is securely mounted to prevent the tipping of fireworks 12 as noted above. Thus, base 24 may be securely mounted to base wall 26 of box 14 by any suitable means, such as glue, adhesive, tape, or any sort of suitable fastener known in the art.

Box 14 includes base wall 26 with a plurality of sidewalls 28 foldably extending therefrom. Box 14 further includes a lid 30 including a plurality of lid walls 32, each foldably extending from a respective sidewall 28.

Electrical conductors 18 include a plurality of electrical wires known in the industry as electrical matches or E-matches 34. E-match 34 is in electrical communication with a respective fuse element 22 adjacent a first end 36 of E-match 34. E-matches 34 are respectively numbered or otherwise marked (not shown), as are fireworks 12 (not shown), to ensure proper connection between respective E-matches 34 and fireworks 12. The connection between E-match 34 and fuse element 22 is described further below. E-match 34 is in electrical communication adjacent a second end 38 thereof with a multi-conductor receptacle 40 having a wire harness therein. Receptacle 40 is removably connected to a multi-conductor electrical plug 42, with receptacle 40 and plug 42 forming an electrical connector 44. Conductors 18 further include a multi-conductor cable 46 which is in electrical communication with plug 42 and electrical control 16. In accordance with a feature of the invention, the multi-conductor connection between receptacle 40 and plug 42 greatly simplifies and expedites the set-up procedure for the consumer.

Electrical control 16 includes a housing 48 on which are mounted a plurality of individual control switches 50 and a plurality of multi-control switches 52. Switches 50 are preferably numbered or otherwise marked (not shown) to correspond to the numbered E-matches 34 and fireworks 12. Control 16 may include electrical wires 54 extending therefrom to connect to an electrical source (not shown) although commonly batteries (not shown) are housed within the housing 48 of control 16 to provide an electrical source to power ignition system 10.

Figure 5:
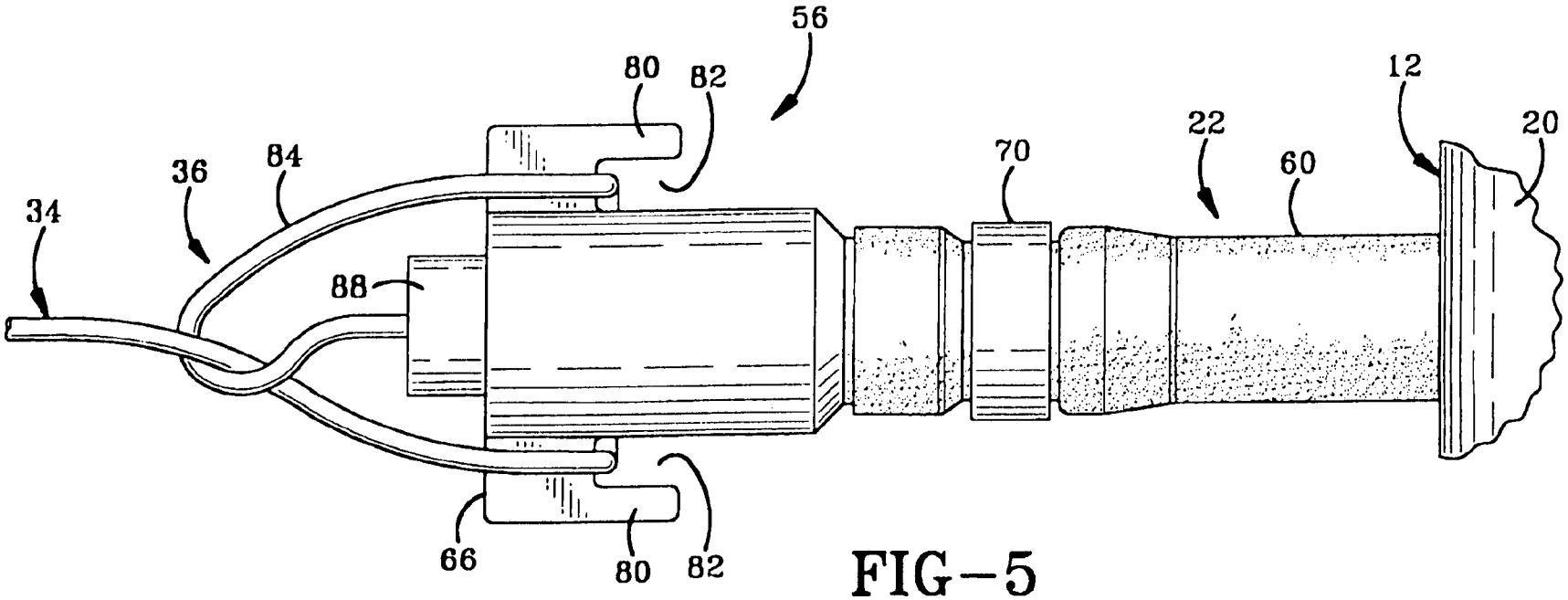
FIG. 5 is an enlarged fragmentary side elevational view of the encircled portion of FIG. 4 showing the electrical match connector of the present invention connecting an electrical match with the fuse of one of the fireworks.
Figure 6:
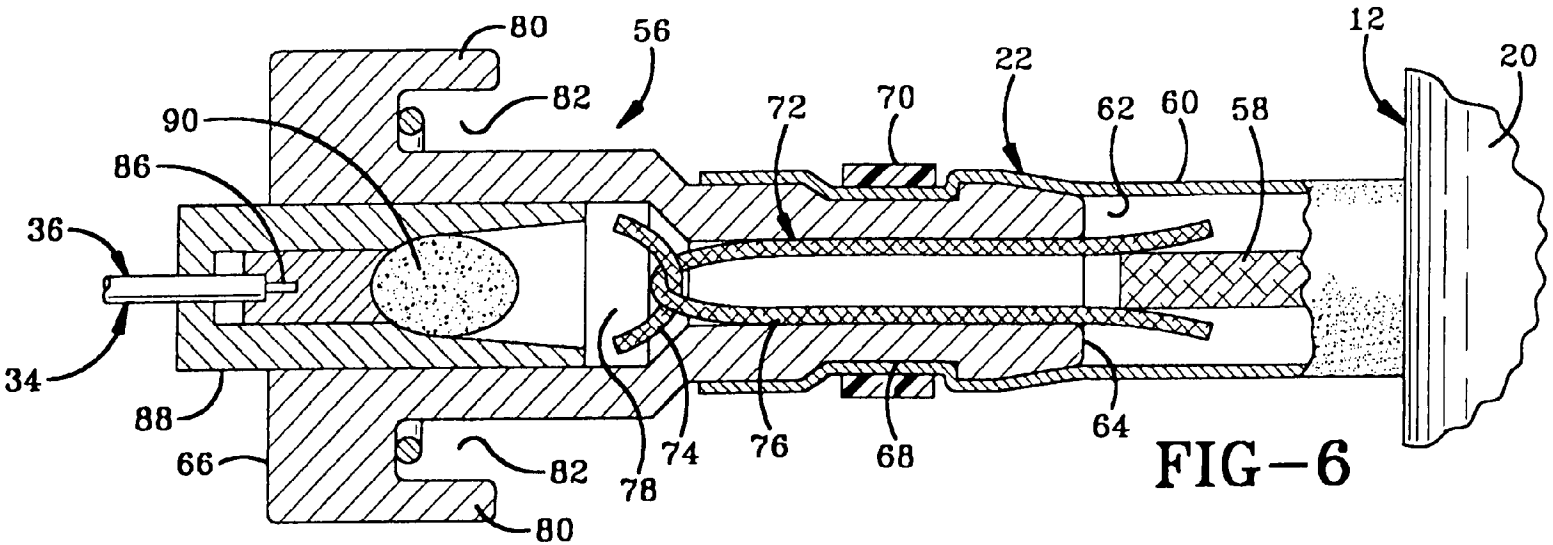
FIG. 6 is a sectional view of the electrical match connector shown in FIG. 5.

With reference to FIGS. 5 and 6, E-match 34 is connected to fuse element 22 with an E-match connector 56. Fuse element 22 includes a quick burning fuse or heavy black match 58 which is enclosed by piping 60, which along with fuse 58 extends outwardly from body 20 of firework 12. Piping 60 defines an interior chamber 62. E-match connector 56 is a hollow structure having a first end 64 and a second end 66 opposed thereto. Adjacent first end 64 of connector 56 is a narrow neck portion 68. First end 64 of connector 56 is inserted into interior chamber 62 of piping 60 and piping 60 is compressed or crimped by a crimping member 70 adjacent neck portion 68 in order to join fuse element 22 to connector 56. Crimping member 70 may, for example, be a metal or plastic ring or a string tie amongst other suitable structures known in the art. Within the hollow connector 56 adjacent first end 64 is another quick-burning fuse in the form of a thin black match 72 which includes a first thin black match piece 74 and a second black match piece 76 looped together. Thin black match piece 76 extends outwardly from within hollow connector 56 from first end 64 thereof toward heavy black match 58 and is disposed closely adjacent thereto or in contact therewith. First thin black match piece 74 is disposed within an enlarged chamber 78 of connector 56 which opens in the direction of second end 66 thereof. Connector 56 further includes a pair of opposed hooks 80 extending radially outwardly from adjacent second end 66 thereof and toward first end 64 thereof, each hook 80 defining an interior space 82 for receiving a portion of E-match 34. E-match 34 adjacent end 36 includes a leg wire 84 which is the portion of E-match 34 which loops around hooks 80 within interior spaces 82 thereof and around itself to tie E-match 34 to connector 56. A tip 86 of E-match 34 is disposed within a hollow shroud 88 and is in electrical communication with an explosive primer 90 disposed within shroud 88. Shroud 88 is disposed within enlarged chamber 78 of connector 56 and secured therein by leg wire 84 of E-match 34. Fuse 22, connector 56 and shroud 88 are all configured to enclose primer 90, thin black match 72 and heavy black match 58 to protect them from inadvertent firing, in particular from the igniting and shooting of other fireworks 12 disposed adjacent thereto. In addition, E-matches 34 are shunted (not shown) during shipping to ensure that E-matches 34 are inert and likewise prevent inadvertent firing.

The operation of system 10 is now described with reference to FIGS. 1-10. Preferably, box 14 and fireworks 12 mounted therein are purchased as a unit with box 10 being formed of a material to protect fireworks 12 from moisture and other elements that may degrade the efficacy of fireworks 12. With reference to FIG. 1, box 14 with fireworks 12 mounted therein is placed on a solid surface 92 which is typically the ground or a platform seated on the ground. FIG. 1 shows box 14 in a closed position. Box 14 further includes a separating mechanism such as a tear strip 94 for separating adjacent sidewalls 28 from one another as further described below. Each strip 94 is disposed at or adjacent an intersection of each pair of adjacent side walls 28.

Figure 2:
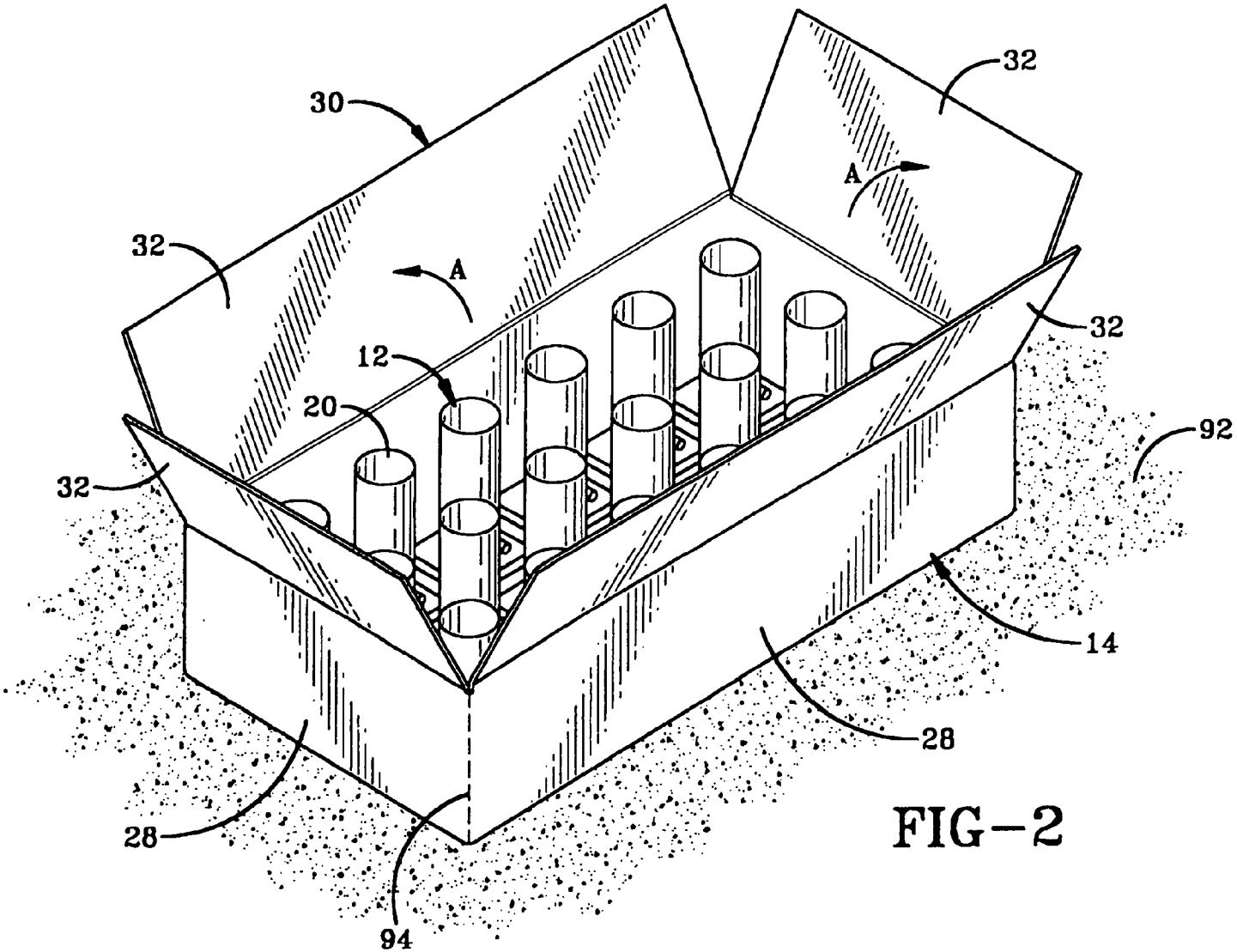
FIG. 2 is a perspective view of the box of FIG. 1 showing the lid opened and consumer fireworks mounted therein.
Figure 3:
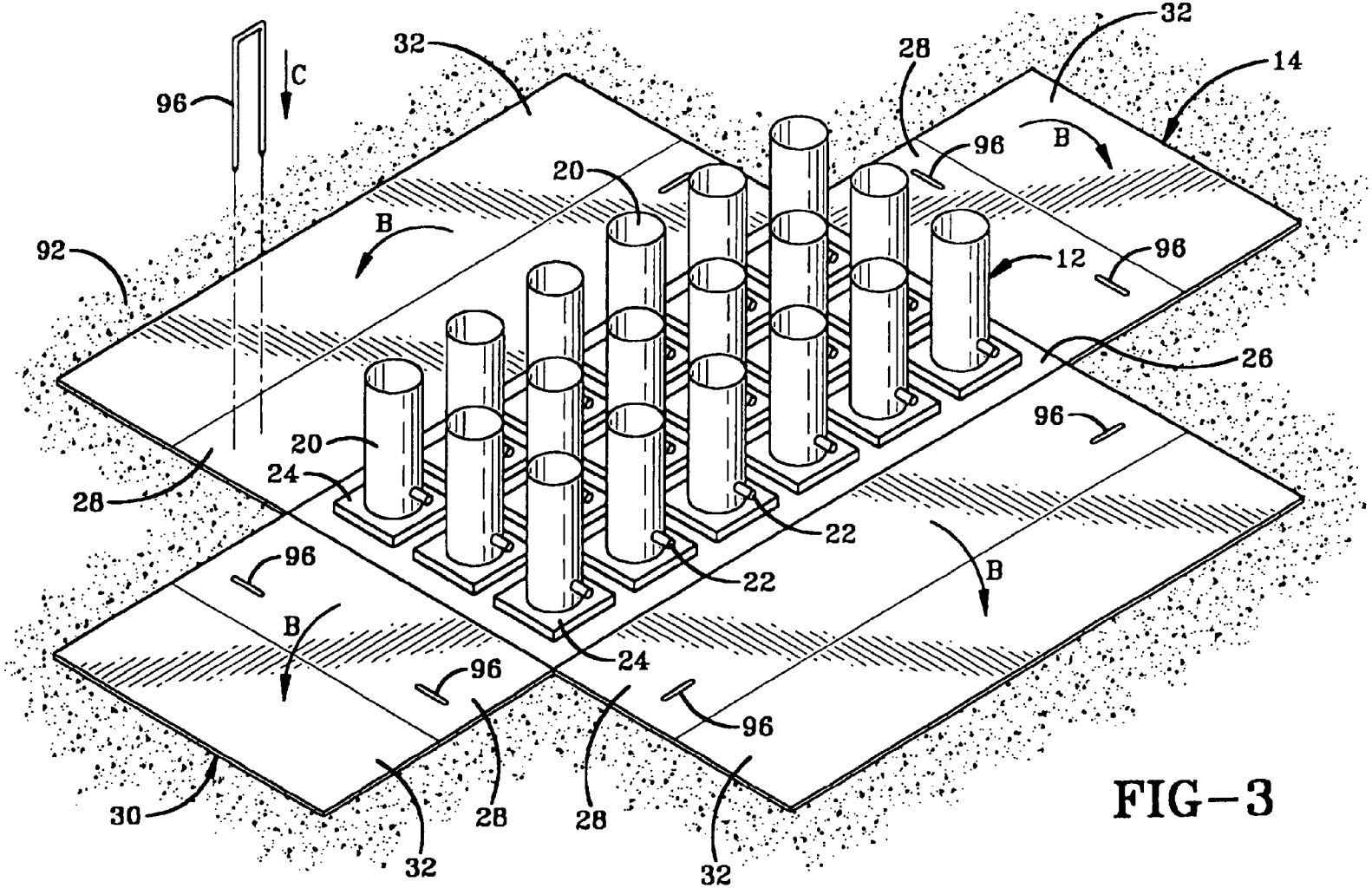
FIG. 3 is a perspective view of the box of the present invention with the lid and sidewalls shown in a fully open position and a stake for securing the sides of the box to the surface.

FIG. 2 shows lid 30 being opened as lid walls 32 move in the general direction of arrows A. Tear strips 94 are torn or a similar mechanism is used in order to separate walls 28 from one another in order to open the box more fully as shown in FIG. 3. This mechanism may simply be perforated corners or may be performed without a built-in mechanism by using a knife, scissors or the like to cut the corners of box 14 between sidewalls 28.

In accordance with the invention and with reference to FIG. 3, lid walls 32 and sidewalls 28 are folded downwardly as shown by arrows B into a substantially flat position on surface 92 with lid walls 32 and side walls 28 substantially coplanar with base wall 26. Also in accordance with the invention, a securing mechanism such as a plurality of stakes 96 is used to secure box 14 in an open and substantially flat position to surface 92 to provide stability for shooting fireworks 12 to ensure the fireworks do not tip over during launching of fireworks 12. This may be achieved by inserting stakes 96 downwardly as shown by arrow C through sidewalls 28 of box 14 into surface 92. Stakes 96 or another securing mechanism may be inserted through lid walls 32 or base wall 26 of box 14 as well to secure box 14 to surface 92.

Once box 14 is secured to surface 92, electrical control 16 is connected via electrical conductors 18 to respective fireworks 12 (FIG. 4). Alternately, some connections may be done prior to securing box 14. Preferably, the consumer would purchase three separate units, one being box 14 with fireworks 12 therein, the second being electrical conductors 18 with multi-conductor receptacle 40 and the third being control 16 with multi-conductor cable 46 and multi-conductor electrical plug 42 connected thereto. Thus, each E-match 34 would be connected to a respective firework 12 by inserting shroud 88 into connector 56 as indicated by arrow D in FIG. 4. This would include securing match 34 to connector 56, preferably by a mechanism similar to the looping of leg wire 84 around hooks 80, as shown in FIG. 5, although any suitable mechanism may be used. Once each E-match is connected to fuse 22 via connector 56, E-matches 34 are connected via receptacle 40 to plug 42 to provide electrical communication between E-matches 34 and electrical control 16. More preferably, the consumer would purchase two separate units, one being box 14 containing fireworks 12, conductors 18 and receptacle 40 with conductors 18 being pre-connected to respective fireworks 12. The other unit would be control 16, cable 46 and plug 42. This would allow the consumer to simply open box 14 and connect receptacle 40 and plug 42 to expedite the set-up process. Thus, box 14 in the closed position contains fireworks 12 and preferably conductors 18 and one of receptacle 40 and plug 42. Control 16 is typically outside box 14 in the closed position, and when conductors 18 are electrically connected to fireworks 12 within box 14, control 16 is thus not in electrical communication with conductors 18. Where receptacle 40 and plug 42 are used, one is thus typically inside box 14 and the other outside box 14 in the closed position.

Preferably, the consumer will have moved to a safe distance before connecting control 16 to an electrical source for additional safety, although control 16 is preferably configured to prevent accidental ignition after the connection of receptacle 40 and plug 42. For example, control 16 may require multiple actions in order to ignite fireworks 12. In addition, control 16 may be configured to include individual test circuits to ensure that each circuit is properly connected.

Once control 16 is properly connected to fireworks 12, the consumer or operator may operate switches 50 or 52 in order to shoot fireworks 12. Individual-control switches 50 allow the operator to shoot a specific firework one at a time or a plurality simultaneously if a plurality of switches 50 is operated simultaneously. Multi-control switches 52 are configured to allow the operator to shoot a plurality of fireworks 12 simultaneously, for instance, an entire row of fireworks 12.

Figure 7:
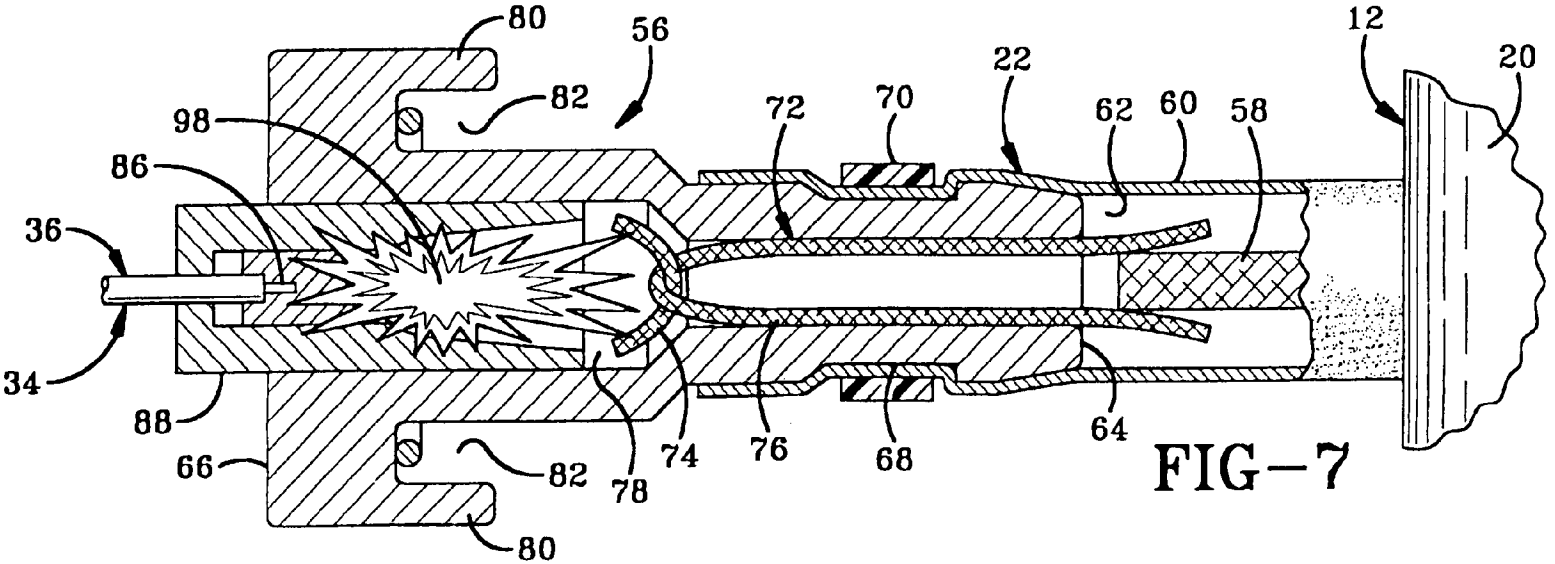
FIG. 7 is similar to FIG. 6 and shows the electrical match firing in order to light the thin black match of the fuse.
Figure 8:
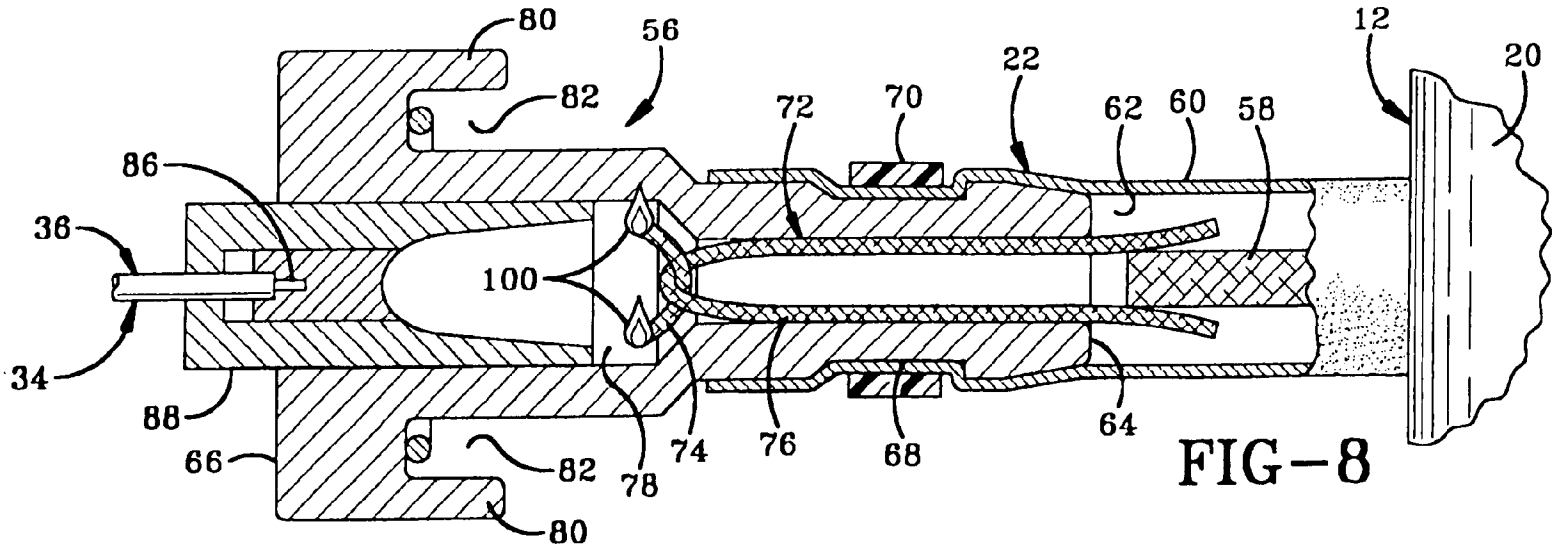
FIG. 8 is similar to FIG. 7 and shows the thin black match at an initial stage of burning.
Figure 9:
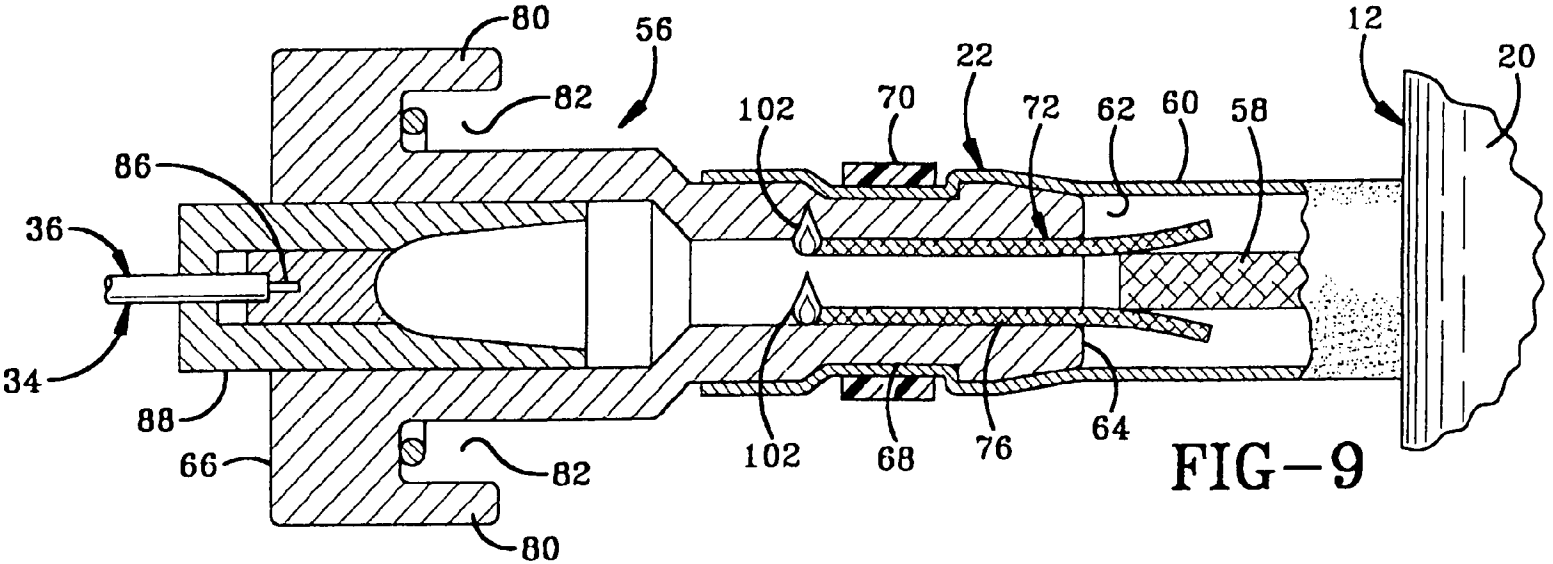
FIG. 9 is similar to FIG. 8 and shows the thin black match in a further stage of burning.
Figure 10:
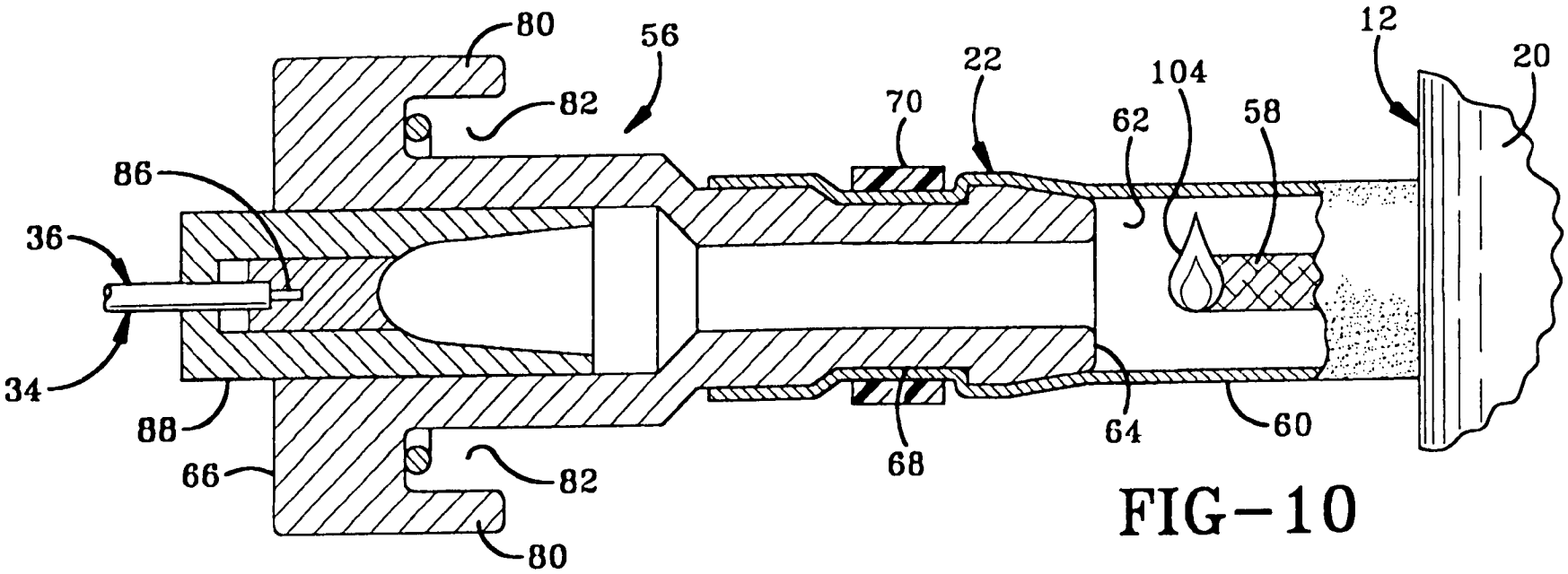
FIG. 10 is similar to FIG. 9 and shows the heavy black match of the fuse burning after having been ignited by the thin black match.

With reference to FIGS. 6-10, the ignition sequence of system 10 is described. FIG. 6 shows E-match 34, primer 90 and fuses 72 and 58 prior to ignition. FIG. 7 shows the integral stage of ignition wherein one of switches 50 or 52 of control 16 has been operated to send an electrical current through E-match 34 to ignite primer 90, which explodes as indicated at 98. Shroud 88 is configured to focus the explosion of primer 90 toward thin black match 72, which is ignited and begins to burn as shown in FIG. 8 at 100. First match piece 74 quickly burns and ignites second match piece 76 as shown at 102 in FIG. 9. In turn, second match piece 76 quickly burns to ignite heavy black match 58 as shown at 104 in FIG. 10. Heavy black match 58 quickly burns to ignite firework 12 in order to shoot firework 12.

Thus, system 10 provides a safe ignition system for shooting 1.4 g fireworks. It will be appreciated that a variety of changes may be made to system 10 which are within the scope of the invention. For example, instead of using a box or container such as box 14 for mounting fireworks 12 thereon, a base or other mounting structure may be used to provide a stable platform to prevent fireworks 12 from tipping over during ignition and shooting thereof. It is preferable however, to use containers such as box 14 in order to provide a compact unit which doubles as a container protecting fireworks 12 from the elements as well as providing the platform from which fireworks 12 are ultimately fired. Box 14 or another platform from which fireworks 12 are fired preferably includes a fire resistant material to prevent box 14 from catching fire and to help prevent any adjacent flammable materials from catching fire during operation of system 10. To that effect, box 14 may be formed of a fire retardant material or may have a liner such as a metallic foil on the interior or may use any other suitable fire retardant mechanism. The use of a container such as box 14 may include removal of the lid or removal of the lid and sidewalls thereof prior to launching fireworks 12. Most importantly, fireworks 12 should be mounted in a manner to prevent them from tipping over for safety reasons. This most preferably includes securing the base or platform from which fireworks 12 are to be shot to the ground or other structure on which the platform is seated. However, the base or platform may be sufficiently stable to prevent fireworks 12 from tipping over without being secured to the ground or other structure.

The electrical connections between fireworks 12 and electrical controls such as control 16 may be continuous as opposed to having removable connections such as receptacle 40 and plug 42. However, the removable nature of receptacle 40 from plug 42 adds another safety step to prevent injury to the operator of system 10. Clearly, however, electrical control 16 may be disconnected from an electrical source to ensure that fireworks 12 will not fire even without the removable connection between such connectors as receptacle 40 and plug 42. Receptacle 40 and plug 42 may be replaced by single-wire connectors as opposed to multi-conductors although the multi-conductor concept is clearly an advantage in expediting the setting up of system 10 for operation.

A variety of setups may also be used with regard to the fuse mechanism and connection with the E-match of a system similar to system 10. For instance, it has been found that the use of a primer such as primer 90 and a fuse such as heavy black match 58 without the use of a thin black match 72 works with a fairly high degree of reliability. Thus, any suitable connection involving the use of an E-match in order to light the fuse of a firework 12 is within the scope of the invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A fireworks ignition system comprising:

a plurality of electrically ignitable 1.4 g fireworks;

a base to which the fireworks are secured to prevent tipping of the fireworks during launch thereof; wherein the base is adapted to sit on a stable surface;

a base-securing mechanism comprising a plurality of stakes for selectively securing the base during launch of the fireworks wherein the securing mechanism is adapted to secure the base to the stable surface;

a control for selectively electrically igniting the respective fireworks;

a plurality of electrical conductors each in electrical communication with a respective one of the fireworks and in selective electrical communication with the control;

a multi-conductor receptacle and a multi-conductor electrical plug which are removably connectable to one another whereby the control is in selective electrical communication with the conductors.

2. The system of claim 1 wherein the base is part of a container which is movable between a closed position in which the fireworks are disposed within the container and an open position in which the fireworks are electrically ignitable and launchable from the container.

3. The system of claim 2 wherein the conductors are disposed within the container when in the closed position.

4. The system of claim 2 wherein the container is fire resistant to help prevent burning the container during launch of the fireworks.

5. The system of claim 1 wherein the base is part of a container which is movable between a closed position in which the fireworks are disposed within the container and an open position in which the fireworks are electrically ignitable and launchable from the container;

the conductors are disposed within the container when in the closed position; and when the container is in the closed position the control is disposed outside the container and not in electrical communication with the conductors.

6. The system of claim 5 wherein one of the receptacle and the plug is disposed in the container when in the closed position and the other of the receptacle and the plug is disposed outside the container when in the closed position.

7. A fireworks ignition system comprising:

a plurality of electrically ignitable 1.4 g fireworks;

a base to which the fireworks are secured to prevent tipping of the fireworks during launch thereof; wherein the base is adapted to sit on a stable surface;

wherein the base is part of a container which is movable between a closed position in which the fireworks are disposed within the container and an open position in which the fireworks are electrically ignitable and launchable from the container; and wherein the container has a plurality of sidewalls and a lid each of which are movable between closed and open positions.

8. The system of claim 7 further including a control for selectively electrically igniting the respective fireworks; and a plurality of electrical conductors each in electrical communication with a respective one of the fireworks and in selective electrical communication with the control.

9. The system of claim 8 further including a multi-conductor receptacle and a multi-conductor electrical plug which are removably connectable to one another whereby the control is in selective electrical communication with the conductors.

10. The system of claim 7 further including a base-securing mechanism for selectively securing the base during launch of the fireworks wherein the securing mechanism is adapted to secure the base to the stable surface.

11. The system of claim 10 wherein the securing mechanism includes a plurality of stakes.

12. The system of claim 11 wherein the stakes are generally U-shaped.

13. The system of claim 7 further comprising a base-securing mechanism comprising a plurality of stakes for selectively securing the base during launch of the fireworks wherein the securing mechanism is adapted to secure the base to the stable surface; and wherein the stakes are selectively insertable through at least one of the base, the lid and the side walls when in the open position.

14. The system of claim 7 wherein the base, lid and side walls are substantially flat and coplanar when in their respective open positions.

15. The system of claim 7 further including a separating mechanism to facilitate separation of side walls which are adjacent one another and allow movement of the sidewalls to their open position.

16. The system of claim 15 wherein the separating mechanism includes a plurality of tear strips adjacent intersections of the adjacent sidewalls.

17. The system of claim 7 further comprising a plurality of electrical conductors each in electrical communication with a respective one of the fireworks; and a control for selectively electrically igniting the respective fireworks via the conductors; wherein when the container is in the closed position the control is disposed outside the container and not in electrical communication with the conductors.

18. The system of claim 17 further comprising a multi-conductor conductor receptacle and a multi-conductor electrical plug which are selectively connectable to one another whereby the control is in selective electrical communication with the conductors; and wherein one of the receptacle and the plug is disposed in the container when in the closed position and the other of the receptacle and the plug is disposed outside the container when in the closed position.

19. A method comprising the steps of:

securing to a stable surface a base on which a plurality of 1.4 g fireworks are mounted in a manner to prevent the tipping of the fireworks during shooting thereof;

opening a container which includes the base from a closed position in which the container contains the fireworks to an open position;

wherein the step of opening includes opening a lid and a plurality of sidewalls into a substantially flat configuration which is substantially coplanar with the base; and igniting electrically at least one of the fireworks when the container is in the open position.

20. The method of claim 19 wherein the step of securing includes inserting a plurality of stakes through at least one of the base, the lid and the sidewalls into the ground.

* * * * *